US008941327B2

(12) United States Patent
Ryu et al.

(10) Patent No.: US 8,941,327 B2
(45) **Date of Patent: *Jan. 27, 2015**

(54) PWM CONTROLLING CIRCUIT AND LED DRIVER CIRCUIT HAVING THE SAME

(75) Inventors: Beom-seon Ryu, Cheongju-si (KR); Chang-sik Lim, Cheongju-si (KR); Tae-kyoung Kang, Cheongju-si (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 147 days.

This patent is subject to a terminal disclaimer.

(21) Appl. No.: 13/397,864

(22) Filed: Feb. 16, 2012

(65) Prior Publication Data

US 2012/0212141 A1 Aug. 23, 2012

(30) Foreign Application Priority Data

Feb. 18, 2011 (KR) ..... 10-2011-0014792

(51) Int. Cl.
*H05B 37/02* (2006.01)
*H05B 33/08* (2006.01)

(52) U.S. Cl.
CPC ..... *H05B 33/0827* (2013.01)
USPC ..... 315/307; 315/185 R

(58) Field of Classification Search
USPC ..... 315/185 R, 291, 294, 297, 302, 307, 315/308, 312, 324, 360
See application file for complete search history.

(56) References Cited

U.S. PATENT DOCUMENTS

| | | | | |
|---|---|---|---|---|
| 7,145,295 | B1 * | 12/2006 | Lee et al. | 315/291 |
| 7,605,550 | B2 * | 10/2009 | Ferentz et al. | 315/312 |
| 2004/0251854 | A1 * | 12/2004 | Matsuda et al. | 315/291 |
| 2007/0296353 | A1 * | 12/2007 | Ito et al. | 315/307 |
| 2009/0295775 | A1 * | 12/2009 | Kim et al. | 345/212 |
| 2010/0148679 | A1 * | 6/2010 | Chen et al. | 315/185 R |
| 2010/0327772 | A1 * | 12/2010 | Lee et al. | 315/297 |
| 2012/0074856 | A1 * | 3/2012 | Takata et al. | 315/192 |

* cited by examiner

*Primary Examiner* — Tung X Le
(74) *Attorney, Agent, or Firm* — NSIP Law

(57) ABSTRACT

A Light Emitting Diode (LED) driver circuit and a Pulse Width Modulation (PWM) controlling circuit thereof is provided. The LED driver circuit includes a voltage detector connected to a plurality of LED arrays, the voltage detector being configured to determine a connection status of each of the LED arrays according to a level of a feedback voltage of each of the LED arrays, and detect a minimum feedback voltage from the feedback voltage of each of the LED arrays that are determined to be connected, a controller configured to output a control signal to control boosting of the LED arrays according to the detected minimum feedback voltage, a PWM signal generator configured to output a PWM signal corresponding to the outputted control signal, and a driving voltage generator configured to supply a driving voltage commonly to the LED arrays according to the PWM signal.

20 Claims, 7 Drawing Sheets

PWM CONTROLLING CIRCUIT AND LED DRIVER CIRCUIT HAVING THE SAME

CROSS-REFERENCE TO RELATED APPLICATIONS

This application claims the benefit under 35 U.S.C. §119 (a) from Korean Patent Application No. 10-2011-0014792 filed on Feb. 18, 2011, in the Korean Intellectual Property Office, the entire disclosure of which is incorporated herein by reference for all purposes.

BACKGROUND

1. Field

The following description relates to a Pulse Width Modulation (PWM) controlling circuit and a Light Emitting Diode (LED) driver circuit having the same. For example, the following description relates to a PWM controlling circuit to generate a PWM signal to control boosting of an LED array according to connection state of a plurality of LED arrays, and an LED driver circuit using the same.

2. Description of Related Art

A Liquid Crystal Display (LCD) is not as thick and weighs less than other display devices. In addition, the LCD requires low driving voltage and power consumption. However, the LCD requires light to operate. As such, since the LCD is a non-light-emitting device that cannot produce light it needs to operate as a display device, a separate backlight is required.

A Cold Cathode Fluorescent Lamp (CCFL) and a plurality of Light Emitting Diodes (LEDs) are used as backlight for the LCD. However, the CCFL can pollute the environment with mercury. In addition, the CCFL exhibits slow response time and low color reproduction, and is not suitable for use in a panel of the LCD that is thin and light.

On the other hand, LEDs are eco-friendly without using harmful substances and allow impulse driving. In addition, LEDs exhibit good color reproduction, arbitrarily change brightness and color temperature by adjusting the light intensity of red, green, and blue LEDs, and are suitable for use in a panel of the LCD that is thin and light. Therefore, LEDs are mostly implemented as the backlight light source for LCD panels.

Meanwhile, when the LCD backlight using the LEDs connects LED arrays including a plurality of LEDs in parallel, a driver circuit supplies constant current to each LED array. Further, a dimming circuit arbitrarily adjusts the brightness and the color temperature to compensate for the temperature.

To maintain uniform brightness and color in the backlight, the driver circuit boosts the driving voltage applied to the LED array. In this case, when the LEDs forming the LED array are open, the voltage of a particular node of the LED array becomes grounded (GND) in the LED Integrated Circuit (IC). Accordingly, the driver circuit performs a continuous boosting operation. At this time, without an overvoltage protection device for the driving voltage applied to the LED array, the boosting of the driving voltage destroys the LED IC.

To prevent this problem, a conventional overvoltage protection technique detects the voltage of a particular node where the driving voltage applied to the LED arrays is divided by a resistor array, and aborts the boosting when the voltage of the particular node exceeds a reference threshold. However, since the driving voltage applied to the LED array is changed according to the change of the LED inch, the conventional technique should separately adjust the resistance value of the resistor array every time the LED inch is changed. As a result, development and test process costs increase.

SUMMARY

In one general aspect, there is provided a Light Emitting Diode (LED) driver circuit, including a voltage detector connected to a plurality of LED arrays, the voltage detector being configured to determine a connection status of each of the LED arrays according to a level of a feedback voltage of each of the LED arrays, and detect a minimum feedback voltage from the feedback voltage of each of the LED arrays that are determined to be connected, a controller configured to output a control signal to control boosting of the LED arrays according to the detected minimum feedback voltage, a Pulse Width Modulation (PWM) signal generator configured to output a PWM signal corresponding to the outputted control signal, and a driving voltage generator configured to supply a driving voltage commonly to the LED arrays according to the PWM signal.

The general aspect of the LED driver circuit may further provide a feedback unit configured to detect the outputted driving voltage, generate a feedback signal based on the detected driving voltage, and output the generated feedback signal to the controller. When determining that none of the LED arrays are connected or a dimming signal configured to drive the LED arrays is off, the controller outputs the control signal to abort the boosting according to the feedback signal.

The general aspect of the LED driver circuit may further provide that the controller including a comparator configured to compare the generated feedback signal and a preset voltage, and generate the control signal according to the comparing of the generated feedback signal and the preset voltage.

The general aspect of the LED driver circuit may further provide that the controller is further configured to generate a high control signal when the generated feedback signal is greater than the preset voltage, and, when the high control signal is input, the PWM signal generator generates the PWM signal so as to abort the boosting.

The general aspect of the LED driver circuit may further provide that the voltage detector is further configured to compare the feedback voltage of each of the LED arrays and a preset voltage, and determine the connection status of each of the LED arrays according to the comparing of the feedback voltage of each of the LED arrays and the preset voltage.

The general aspect of the LED driver circuit may further provide that the preset voltage is 0V or 0.2V.

The general aspect of the LED driver circuit may further provide comparators respectively corresponding to the LED arrays, the comparators being configured to compare the feedback voltage of each of the LED arrays and a preset voltage, and determine and output the connection status of each of the LED arrays according to the comparing of the feedback voltage of each of the LED arrays and the preset voltage, and a minimum feedback voltage selector configured to receive the connection status of each of the LED arrays from the comparators, and the feedback voltage of each of the LED arrays, and detect and output the minimum feedback voltage from the feedback voltage of each of the LED arrays to the controller.

The general aspect of the LED driver circuit may further provide that the controller includes a comparator configured to compare the detected minimum feedback voltage and a preset voltage, and generate the control signal according to the comparing of the detected minimum feedback voltage and the preset voltage, and the preset voltage is greater than a voltage configured to operate a transistor that drives each of the LED arrays that are determined to be connected in a saturation region.

The general aspect of the LED driver circuit may further provide that the comparator is a switching signal and receives an input of a dimming signal configured to drive the LED arrays.

The general aspect of the LED driver circuit may further provide that the controller is further configured to generate the control signal when the dimming signal is on and the minimum feedback voltage is greater than the preset voltage, and the PWM signal generator generates the PWM signal to abort the boosting when the control signal is received having a high state.

The general aspect of the LED driver circuit may further provide that the preset voltage includes two different voltages of hysteresis property.

In another general aspect, there is provided a Pulse Width Modulation (PWM) controlling circuit, including a voltage detector connected to a plurality of Light Emitting Diode (LED) arrays, the voltage detector being configured to determine a connection status of each of the LED arrays according to a level of a feedback voltage of each of the LED arrays, and output a control voltage to control boosting of the LED arrays according to the determined connection status, and a PWM signal generator configured to output a PWM signal to control the boosting of the LED arrays according to the outputted control voltage.

Other features and aspects may be apparent from the following detailed description, the drawings, and the claims.

Figure 1:
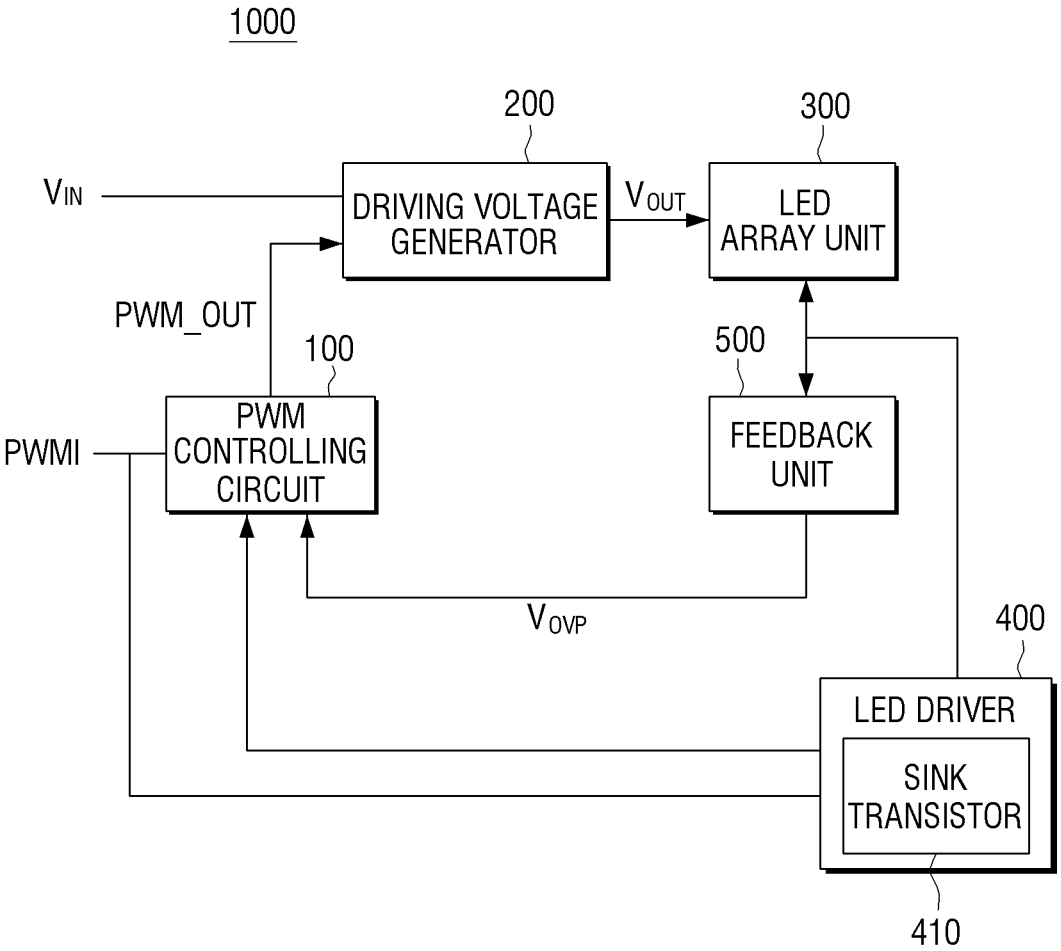
FIG. 1 is a block diagram illustrating an example of an LED driver circuit according to a general aspect.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

FIG. 1 is a block diagram illustrating an example of an LED driver circuit 1000 according to a general aspect. Referring to FIG. 1, the LED driver circuit 1000 includes a Pulse Width Modulation (PWM) controlling circuit 100, a driving voltage generator 200, an LED array unit 300, an LED driver 400, and a feedback unit 500.

The LED driver circuit 1000 prevents overvoltage from being applied to an LED array unit 300 according to connection status of LED arrays within the LED array unit 300. For example, when every LED array of the LED array unit 300 is disconnected, the LED driver circuit 1000 receives, from the feedback unit 500, a fed-back driving voltage applied to the LED array unit 300, and uses the fed-back driving voltage to control boosting of a driving voltage $V_{OUT}$ to the LED arrays of the LED array unit 300. On the other hand, when at least one LED array of the LED array unit 300 is connected, the LED driver circuit 1000 receives a minimum drain voltage (hereafter, also referred to as a minimum feedback voltage of the feedback voltages of the LED array), which is fed back, of drain voltages of a sink transistor 410 of the LED driver 400 to drive the LED arrays of the LED array unit 300, and uses the minimum drain voltage to control boosting of the driving voltage $V_{OUT}$ to the LED arrays of the LED array unit 300.

Herein, the boosting control of the LED driver circuit 1000 by using the driving voltage feedback can be referred to as external overvoltage protection, as the driving voltage $V_{OUT}$ applied to the LED arrays of the LED array unit 300 is divided through an external resistor array of the feedback unit 500. The divided driving voltage is used by the LED driver circuit 1000 to control the boosting of the driving voltage $V_{OUT}$ to the LED arrays of the LED array unit 300. The boosting control of the LED driver circuit 1000 based on the feedback of the drain voltage of the sink transistor 410 of the LED driver 400 connected to the LED arrays of the LED array unit 300 can be referred to as internal overvoltage protection, as the drain voltage of the sink transistor 410 and the LED driver 400 is used by the LED driver circuit 1000 to control the boosting of the driving voltage $V_{OUT}$ to the LED arrays of the LED array unit 300. That is, the LED driver circuit 1000 can serve as an overvoltage protection circuit for preventing the overvoltage applied to the LED arrays of the LED array unit using external overvoltage protection and internal overvoltage protection.

The PWM controlling circuit 100 is connected to the LED arrays of the LED array unit 300. The PWM controlling circuit 100 receives a feedback voltage from each LED array of the LED array unit 300, and determines the connection status of the LED arrays of the LED array unit 300 according to the levels of the received feedback voltages. Herein, the feedback voltage of each of the LED arrays indicates a drain voltage of the sink transistor 410 of the LED driver 400 to drive each of the LED arrays of the LED array unit 300.

The PWM controlling circuit 100 generates a control signal to control the boosting of the LED arrays of the LED array unit 300 according to the connection status of the LED arrays, and outputs a PWM signal PWM_OUT corresponding to the control signal. For example, upon determining that none of the LED arrays are connected, the PWM controlling circuit 100 can generate a control signal to abort the boosting of the LED arrays of the LED array unit 300 by using the driving voltage $V_{OUT}$ commonly applied to the LED arrays of the LED array unit 300.

On the other hand, when at least one LED array is connected, the PWM controlling circuit 100 detects the minimum feedback voltage of the feedback voltages of the LED arrays that are determined to be connected, and generates a control signal to control the boosting of the LED arrays according to the detected minimum feedback voltage. That is, the PWM controlling circuit 100 can receive the minimum drain voltage of the drain voltages of the sink transistor 410 of the LED driver 400 to drive the LED arrays that are determined to be connected, and generate the control signal to control the boosting of the LED arrays.

Figure 3:
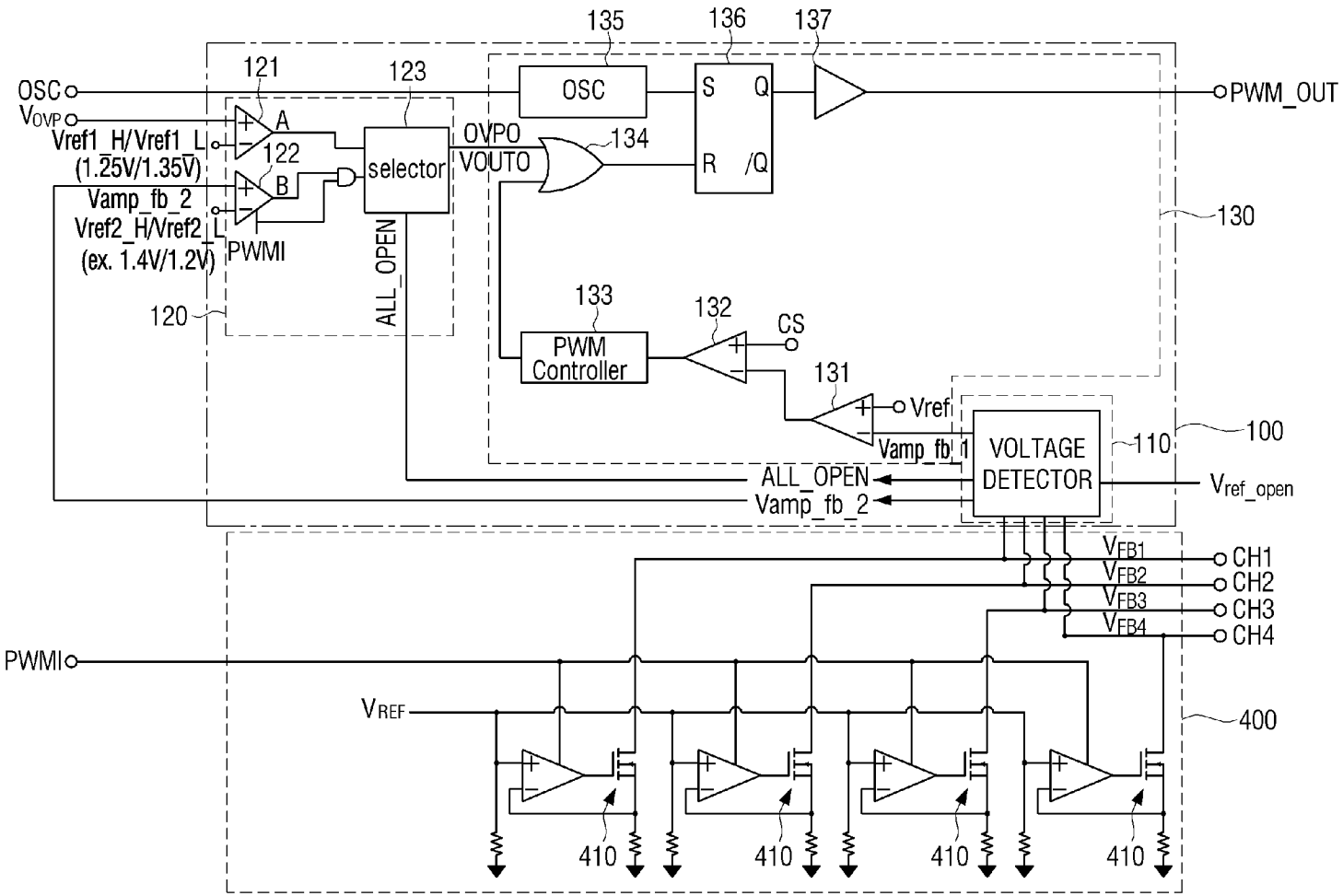
FIG. 3 is a circuit diagram illustrating an example of a PWM controlling circuit and a LED driver according to a general aspect.

Operations and structure of the PWM controlling circuit 100 shall be described by referring to FIG. 3.

The driving voltage generator 200 supplies the driving voltage $V_{OUT}$ to the LED arrays of the LED array unit 300 according to the PWM signal PWM_OUT. For example, the driving voltage generator 200 converts DC voltage $V_{IN}$ based on the PWM signal PWM_OUT generated by the PWM controlling circuit 100, and supplies the converted DC voltage as the driving voltage $V_{OUT}$ to the LED arrays of the LED array unit 300. The LED arrays of the LED array unit 300 are connected in parallel and commonly receive the driving voltage $V_{OUT}$ generated by the driving voltage generator 200.

The LED driver 400 can adjust the driving current of the LED array unit 300 by using the PWM signal and a dimming signal PWMI. For example, the LED driver 400 includes the sink transistor 410 to drive the LED arrays of the LED array unit 300, and functions as a constant current controller to control a flow of the constant current through the LED arrays of the LED array unit 300 by using the dimming signal PWMI.

The feedback unit 500 detects the driving voltage $V_{OUT}$ commonly applied to the LED arrays of the LED array unit 300 and outputs a feedback signal $V_{OVP}$. For example, the feedback unit 500 divides the driving voltage $V_{OUT}$ commonly applied to the LED arrays of the LED array unit 300 and provides the divided voltage to the PWM controlling circuit 100 as the feedback signal $V_{OVP}$. To divide the driving voltage $V_{OUT}$, the feedback unit 500 includes a resistor array including resistors R_OVPH and R_OVPL, as illustrated in FIG. 2, having a preset resistance value.

Figure 2:
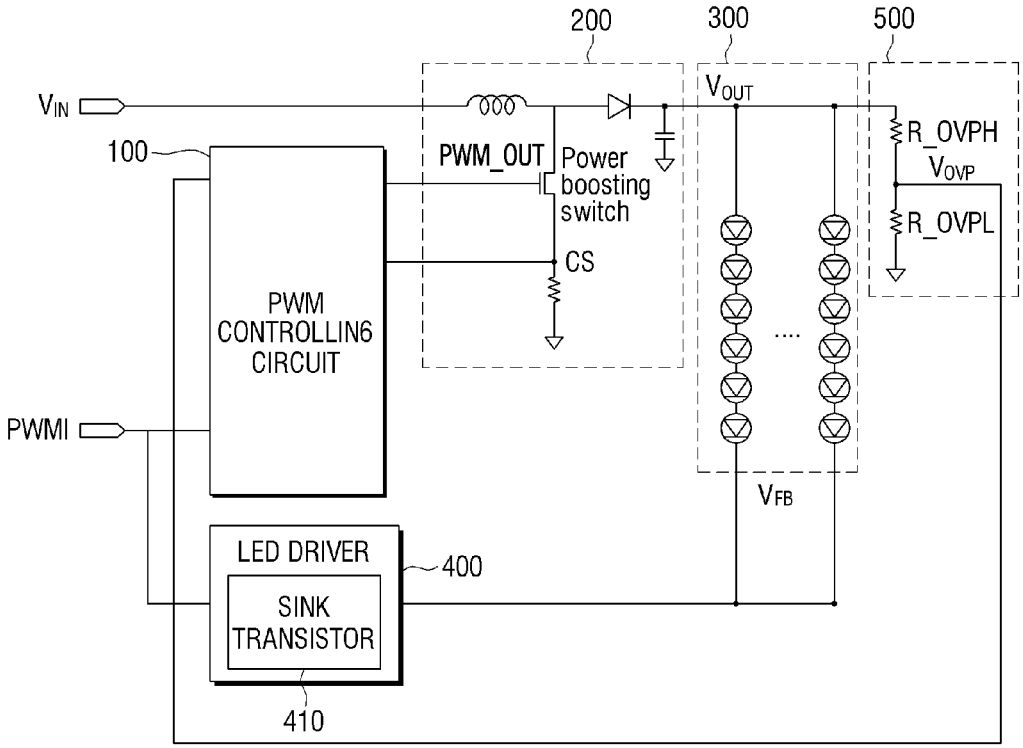
FIG. 2 is a circuit diagram illustrating an example of the LED driver circuit according to a general aspect.

FIG. 2 is a circuit diagram illustrating an example of the LED driver circuit 1000 according to a general aspect. Referring to FIG. 2, the LED driver circuit 1000 includes the PWM controlling circuit 100, the driving voltage generator 200, the LED array unit 300, the LED driver 400, and the feedback unit 500. The PWM controlling circuit 100, the driving voltage generator 200, the LED array unit 300, the LED driver 400, and the feedback unit 500 can be implemented as a single chip. Parts of FIG. 1 that overlap with FIG. 2 are omitted in FIG. 2.

The PWM controlling circuit 100 connected to the LED arrays of the LED array unit 300 determines the connection status of the LED arrays and generates the PWM signal PWM_OUT to control the boosting of the LED arrays of the LED array unit 300 according to the connection status. For doing so, the PWM controlling circuit 100 uses either the feedback signal $V_{OVP}$ from the feedback unit 500 or the minimum drain voltage of the sink transistor 410 of the LED driver 400 to drive the LED arrays that are connected as the minimum feedback voltage of the LED arrays of the LED array unit 300.

The driving voltage generator 200 can include an inductor, a power boosting switch, and a booster switcher including a diode. For example, the driving voltage generator 200 performs the same operations as a general booster switcher by boosting the driving voltage $V_{OUT}$ supplied to the LED arrays of the LED array unit 300 according to the PWM signal PWM_OUT. The LED array unit 300 includes a plurality of LED arrays connected in parallel. The LED driver 400, as a constant current controller, controls the flow of the constant current in each of the LED arrays of the LED array unit 300.

The feedback unit 500 includes resistors R_OVPH and R_OVPL to divide the driving voltage $V_{OUT}$ commonly applied to the LED arrays of the LED array unit 300, and generate the feedback signal $V_{OVP}$. The resistors R_OVPH and R_OVPL of the feedback unit 500 may have different resistance values according to the number and type of LEDs in the LED arrays of the LED array unit 300, because a target voltage Vout_target, illustrated in FIGS. 5-7, to be applied to the LED arrays of the LED array unit 300 differs according to the number and type of the LEDs of the LED arrays of the LED array unit 300.

While each of the LED arrays illustrated in FIG. 2 includes six LEDs by way of example, a smaller or greater number of LEDs may be included in the LED arrays. The feedback unit 500 includes two different resistors R_OVPH and R_OVPL by way of example. If the feedback unit 500 can provide the feedback voltage to the PWM controlling circuit 100 as the feedback signal $V_{OVP}$, the feedback unit 500 may include a greater or smaller number of resistors.

FIG. 3 is a circuit diagram illustrating an example of a PWM controlling circuit 100 and a LED driver 400 according to a general aspect. Referring to FIG. 3, the PWM controlling circuit 100 generates the PWM signal PWM_OUT provided to the driving voltage generator 200, and includes a voltage detector 110, a controller 120, and a PWM signal generator 130.

The voltage detector 110 is connected to the LED arrays CH1 through CH4 via the LED driver 400. The voltage detector 110 receives the feedback voltages $V_{FB1}$ through $V_{FB4}$ from each LED array CH1 through CH4, and determines the connection status of the LED arrays CH1 through CH4 according to the levels of the received feedback voltages $V_{FB1}$ through $V_{FB4}$. Herein, the feedback voltage $V_{FB1}$ through $V_{FB4}$ of each of the LED arrays CH1 through CH4 indicates the drain voltage of the sink transistor 410 to drive the LED arrays CH1 through CH4.

For example, the voltage detector 110 determines the connection status of the LED arrays CH1 through CH4 by comparing the feedback voltages $V_{FB1}$ through $V_{FB4}$ of the LED arrays CH1 through CH4 and a preset voltage Vref_open. Herein, the connection status of the LED arrays CH1 through CH4 indicates whether the LED arrays CH1 through CH4 are open (disconnected) according to the open or the close of the LED.

That is, as the driving voltage $V_{OUT}$ supplied to the LED arrays CH1 through CH4 increases, the feedback voltages $V_{FB1}$ through $V_{FB4}$ of the LED arrays CH1 through CH4 should increase as well. However, when the driving voltage $V_{OUT}$ applied to the LED arrays CH1 through CH4 increases and the feedback voltages $V_{FB1}$ through $V_{FB4}$ of the LED arrays CH1 through CH4 do not increase and approach the preset voltage Vref_open (for example, 0V or 0.2V), the voltage detector 110 determines the open of the corresponding LED array.

The voltage detector 110 can detect and output a feedback voltage Vamp_fb_1 to boost the initial driving voltage applied to the LED arrays CH1 through CH4. Herein, the feedback voltage Vamp_fb_1 indicates the minimum drain voltage of the drain voltages of the sink transistor 410 of the LED driver 400 to drive the LED arrays CH1 through CH4, or the minimum feedback voltage of the feedback voltages $V_{FB1}$ through $V_{FB4}$ of the LED arrays CH1 through CH4. The feedback voltage Vamp_fb_1 may be set to ground (GND) level until a certain status of the initial boosting of the LED arrays CH1 through CH4 is reached.

For example, when determining that none of the LED arrays are connected, the voltage detector 110 sets the feedback voltage Vamp_fb_1 to the GND level until the driving voltage $V_{OUT}$ supplied to the LED arrays CH1 through CH4 reaches a preset voltage V_ovp_TH, as is illustrated in FIGS.

5-7. When determining that at least one LED array is connected, the voltage detector 110 sets the feedback voltage Vamp_fb_1 to the GND level until the feedback voltage Vamp_fb_2, which is input into a comparator 122 in the controller 120, reaches a preset voltage Vref2, as is illustrated in FIGS. 3 and 5-7.

Figure 5:
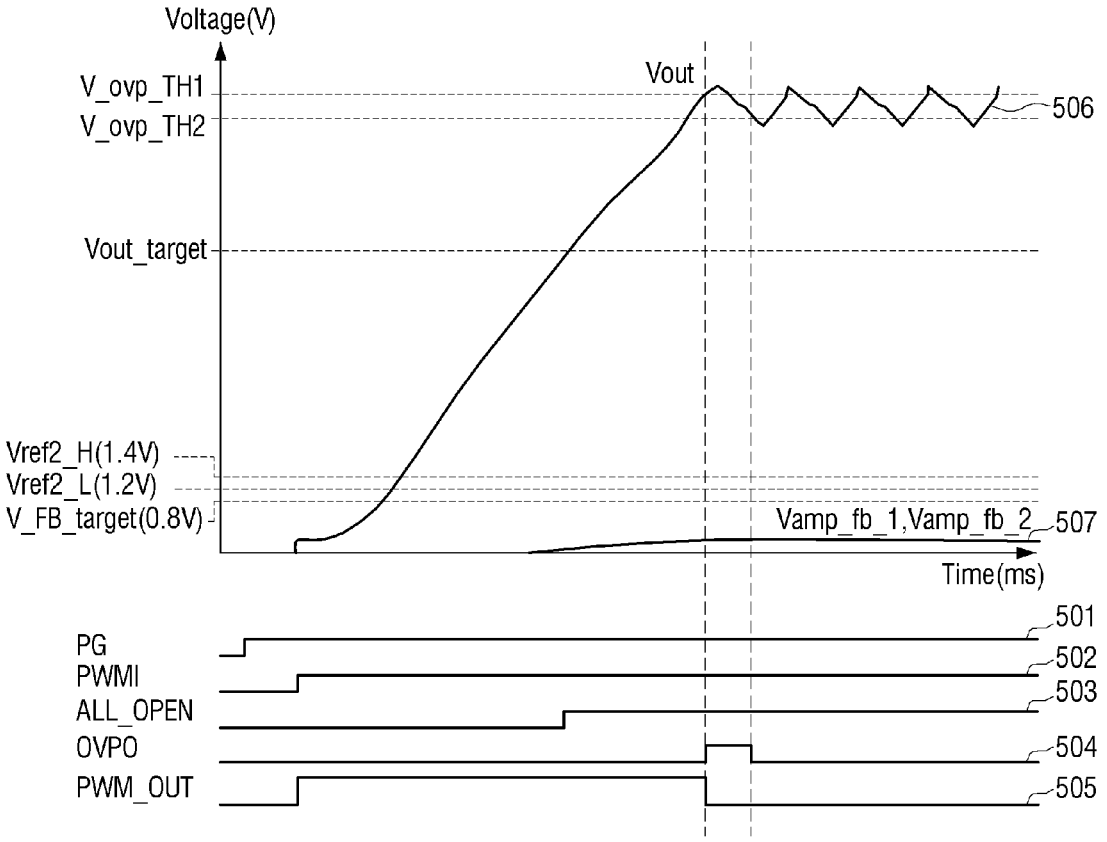
FIGS. 5 through 7 are waveform diagrams illustrating examples of operations of the LED driver circuit according to a general aspect.
Figure 6:
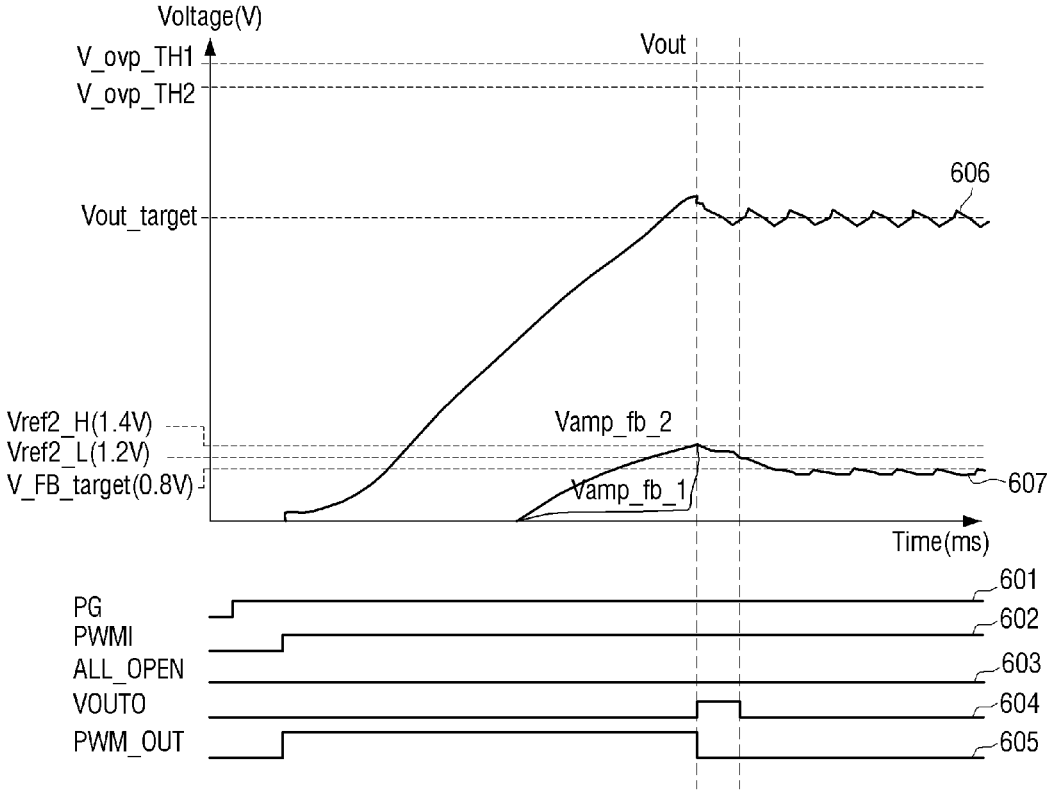
Figure 7:
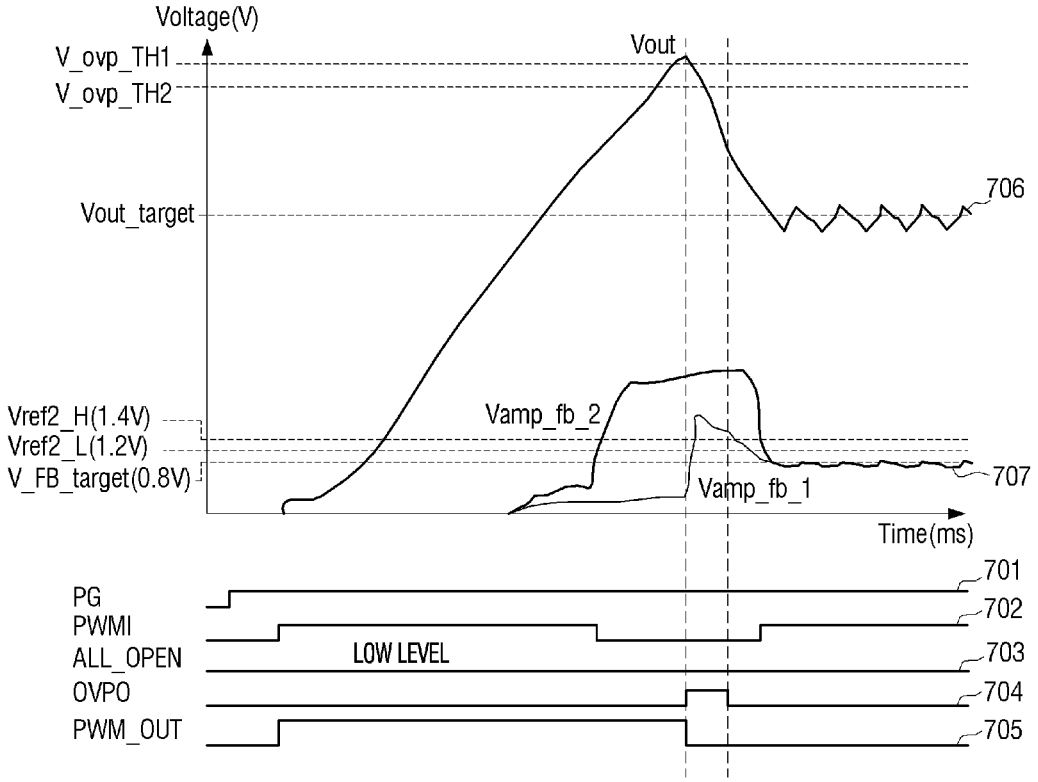

As is illustrated in FIGS. 5-7, the preset voltage V_ovp_TH indicates the voltage to prevent the overvoltage supply to the LED arrays CH1 through CH4 according to the external overvoltage protection, and can be set to two different voltages V_ovp_TH1 and V_ovp_TH2 of hysteresis property. The preset voltage V_ovp_TH can differ according to the number of the LEDs forming the LED arrays CH1 through CH4.

As is illustrated in FIGS. 5-7, the preset voltage Vref2 is the voltage to prevent the overvoltage supply to the LED arrays CH1 through CH4 according to the internal overvoltage protection and can be set to two different voltages Vref2_H and Vref2_L (1.4V/1.2V, respectively) of hysteresis property.

Next, as is illustrated in FIGS. 5-7, when the driving voltage $V_{OUT}$ supplied to the LED arrays CH1 through CH4 reaches the preset voltage V_ovp_TH or the feedback voltage Vamp_fb_2 reaches the preset voltage Vref2, the voltage detector 110 outputs the minimum drain voltage of the drain voltages of the sink transistor 410 of the LED driver 400 to drive the LED arrays CH1 through CH4, or the minimum feedback voltage of the feedback voltages $V_{FB1}$ through $V_{FB4}$ of the LED arrays CH1 through CH4, as the feedback voltage Vamp_fb_1.

The voltage detector 110 detects and outputs the feedback voltage Vamp_fb_2 to prevent the overvoltage supply to the LED arrays CH1 through CH4. For example, when determining that at least one LED array is connected, the voltage detector 110 outputs the minimum feedback voltage of the feedback voltages of the LED arrays CH1 through CH4 that are connected, that is, the minimum drain voltage of the drain voltages of the sink transistor 410 of the LED driver 400 connected to the LED arrays CH1 through CH4 that are connected, as the feedback voltage Vamp_fb_2.

As stated above, the voltage detector 110 detects the minimum drain voltage of the drain voltages of the sink transistor 410 of the LED driver 400 of the LED arrays CH1 through CH4, or the minimum feedback voltage of the feedback voltages $V_{FB1}$ through $V_{FB4}$ of the LED arrays CH1 through CH4, and outputs the feedback voltage Vamp_fb_1 to initially boost of the LED arrays CH1 through CH4. In addition, the voltage detector 110 outputs the feedback voltage Vamp_fb_2 to prevent the overvoltage applied to the LED arrays CH1 through CH4 according to the internal overvoltage protection.

In addition, when determining that all of the LED arrays CH1 through CH4 are disconnected, the voltage detector 110 outputs a selection signal ALL_OPEN indicating that all LED arrays CH1 through CH4 are disconnected.

The controller 120 may generate a first control signal OVPO to control the boosting of the LED arrays CH1 through CH4 according to the connection status of the LED arrays, and output the generated control signal to the PWM signal generator 130. For example, when determining that none of the LED arrays CH1 through CH4 are connected or a dimming signal PWMI to drive LED arrays CH1 through CH4 is off, the controller 120 outputs a control signal OVPO to abort the boosting of the LED arrays CH1 through CH4 according to a feedback signal $V_{OVP}$ generated by the feedback unit 500 of FIG. 2.

When determining that at least one of the LED arrays CH1 through CH4 is connected, the controller 120 outputs the second control signal VOUTO to control the boosting of the LED arrays CH1 through CH4 according to the minimum feedback voltage of the feedback voltages of the LED arrays CH1 through CH4 that are connected, that is, the minimum drain voltage of the drain voltages of the sink transistor 410 of the LED driver 400 to drive the LED arrays CH1 through CH4.

The controller 120 may include a first comparator 121, a second comparator 122, and a selector 123. The first comparator 121 generates the first control signal OVPO by receiving the feedback signal $V_{OVP}$ generated by the feedback unit 500 of FIG. 2 and the preset voltage. For example, when the feedback voltage generated by the feedback unit 500 as the feedback signal $V_{OVP}$ reaches the preset voltage Vref1, the first comparator 121 generates the high control signal OVPO. Herein, the preset voltage Vref1 indicates the voltage for determining whether the driving voltage $V_{OVP}$ supplied to the LED arrays CH1 through CH4 reaches the preset voltage V_ovp_TH using the feedback voltage generated by the feedback unit 500 as the feedback signal $V_{OVP}$, and may be set to two different voltages Vref1_H and Vref1_L of 1.35 V and 1.25 V, respectively, according to the hysteresis property. Hence, when the driving voltage $V_{OUT}$ supplied to the LED arrays CH1 through CH4 reaches the preset voltage V_ovp_TH, the first comparator 121 generates the high control signal OVPO.

The second comparator 122 may generate the second control signal VOUTO by receiving the minimum feedback voltage Vamp_fb_2 of the LED arrays CH1 through CH4 that are connected and the preset voltage Vref2. For example, when the minimum feedback voltage Vamp_fb_2 of the LED arrays CH1 through CH4 that are connected, that is, the minimum drain voltage Vamp_fb_2 of the drain voltages of the sink transistor 410 of the LED driver 400 to drive the LED arrays CH1 through CH4 that are connected, reaches the preset voltage Vref2, the second comparator 122 generates the second control signal VOUTO of the high state. Herein, the preset voltage Vref2 indicates the voltage greater than the voltage V_FB_target to operate the sink transistor 410 of the LED driver 400 to drive the LED arrays CH1 through CH4 that are connected in the saturation region and may be set to two different voltages Vref2_H and Vref2_L (1.4V/1.2V, respectively) of hysteresis property.

In addition, the second comparator 122 is a switching signal and receives a dimming signal PWMI to drive the LED arrays CH1 through CH4. For example, if a dimming signal PWMI to operate the sink transistor 410 of the LED driver 400 is on, the second comparator 122 generates a control signal VOUTO. However, if the dimming signal PWMI is off, the second comparator 122 does not generate a control signal VOUTO.

The selector 123 outputs a control signal OVPO or VOUTO by selecting between outputs of the first and second comparators 121, 122 according to the selection signal ALL_OPEN. For example, when determining that at least one of the LED arrays CH1 through CH4 is connected, the selector 123 may select the control signal VOUTO generated by the second comparator 122. On the other hand, when determining that none of the LED arrays CH1 through CH4 are connected or a dimming signal PWMI to operate the sink transistor 410 of the LED driver 400 is off, the selector 123 may select the control signal OVPO generated by the first comparator 121.

Accordingly, the control signal OVPO has a high state when none of the LED arrays CH1 through CH4 are connected or a dimming signal PWMI to operate the sync transistor 410 of the LED driver 400 is off, and the feedback voltage $V_{OVP}$ generated by the feedback unit 500 reaches the preset voltage Vref1. In addition, the control signal VOUTO has a high state when it is determined that at least one of the LED arrays CH1 through CH4 is connected and the minimum feedback voltage Vamp_fb_2 of the connected LED arrays CH1 through CH4 that are connected reaches the preset voltage Vref2.

The PWM signal generator 130 may generate the PWM signal PWM_OUT provided to the driving voltage generator 200 through receipt of either the control signal OVPO or the control signal VOUTO. For example, when receiving the control signal OVPO of the high state, the PWM signal generator 130 generates PWM signal PWM_OUT to abort the boosting. The PWM signal generator 130 includes a third comparator 131, a fourth comparator 132, a PWM controller 133, an OR gate 134, an oscillator 135, an RS flip-flop 136, and a buffer 137.

The third comparator 131 receives and outputs the feedback voltage Vamp_fb_1 of the LED arrays CH1 through CH4 and the preset voltage $V_{REF}$ to the fourth comparator 132.

For example, when the feedback voltage Vamp_fb_1 of the LED arrays CH1 through CH4 is less than the preset voltage $V_{REF}$, the third comparator 131 outputs a signal to boost the driving voltage $V_{OUT}$ applied to the LED arrays CH1 through CH4. When the feedback voltage Vamp_fb_1 of the LED arrays CH1 through CH4 is greater than the preset voltage $V_{REF}$, the third comparator 131 outputs a signal to abort the boosting of the driving voltage $V_{OUT}$ applied to the LED arrays CH1 through CH4. Herein, the preset voltage $V_{REF}$ indicates the voltage to operate the sink transistor 410 of the LED driver 400 to drive the LED arrays CH1 through CH4 in the saturation region. As such, the preset voltage $V_{REF}$ is defined to give constant brightness to the LED arrays CH1 through CH4 by flowing the constant current in the LED array unit 300 of FIG. 2.

Meanwhile, the feedback voltage Vamp_fb_1 is set to the GND level until the driving voltage $V_{OUT}$ applied to the LED arrays CH1 through CH4 reaches the preset voltage V_ovp_TH or the feedback voltage Vamp_fb_2 reaches the preset voltage Vref2 as mentioned earlier. Accordingly, the third comparator 131 outputs the signal to boost the voltage applied to the LED arrays CH1 through CH4 until the driving voltage $V_{OUT}$ applied to the LED arrays CH1 through CH4 reaches the preset voltage V_ovp_TH or the feedback voltage Vamp_fb_2 reaches the preset voltage Vref2.

The fourth comparator 132 receives and provides the outputs of a Common Source (CS) stage (FIG. 2) of the transistor of the driving voltage generator 200 of FIG. 2 and the third comparator 131, to the PWM controller 133. The fourth comparator 132 compares the current flowing through the CS stage and the output of the third comparator 131 and outputs a signal to boost the voltage applied to the LED arrays CH1 through CH4 or a signal to abort the boosting.

The PWM controller 133 receives and provides the output of the fourth comparator 132 to the OR gate 134. The OR gate 134 receives and provides the control signals OVPO or VOUTO generated by the controller 120 and the output signal of the PWM controller 133, to the RS flip-flop 136. The oscillator 135 generates a clock signal having a preset frequency.

The RS flip-flop 136 receives the clock signal of the oscillator 135 as the set input and the output of the OR gate 134 as the reset input. The RS flip-flop 136 provides the PWM signal to the driving voltage generator 200 of FIG. 2 via the buffer 137. Herein, the RS flip-flop 136 is a flip-flop for outputting the high state when the set signal is input and the low state when the reset signal is input. That is, the PWM signal generator 130 generates the signal to boost the driving voltage $V_{OUT}$ applied to the LED arrays CH1 through CH4 according to the clock signal of the oscillator 135, which continues until the feedback voltage Vamp_fb_1 reaches the preset voltage $V_{REF}$.

Meanwhile, if either the driving voltage $V_{OUT}$ applied to the LED arrays CH1 through CH4 according to the connection status of the LED arrays CH1 through CH4 reaches the preset voltage V_ovp_TH or the feedback voltage Vamp_fb_2 reaches the preset voltage Vref2, the PWM signal generator 130 either generates a signal to abort the boosting by the control signal OVPO or a signal to provide boosting by the control signal VOUTO, respectively.

Figure 4:
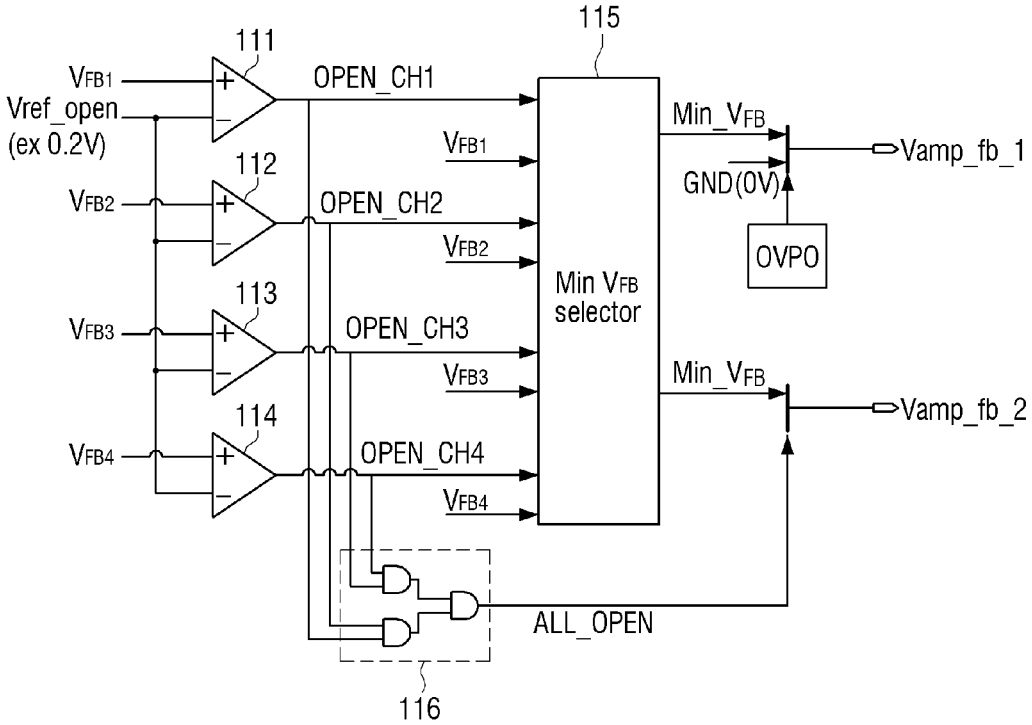
FIG. 4 is a circuit diagram illustrating an example of operations of a voltage detector according to a general aspect.

FIG. 4 is a circuit diagram illustrating an example of operations of a voltage detector 110 according to a general aspect. Referring to FIG. 4, the feedback voltages $V_{FB1}$ through $V_{FB4}$ of the four LED arrays CH1 through CH4 illustrated in FIG. 3 are input to the comparators 111 through 114. The comparators 111 through 114 compare the feedback voltages $V_{FB1}$ through $V_{FB4}$ and the preset voltage Vref_open (for example, 0V or 0.2V), determine the connection status of the LED arrays CH1 through CH4, and output the connection status to a minimum feedback voltage selector 115. The minimum feedback voltage selector 115 detects and outputs the minimum feedback voltage Min_$V_{FB}$ of the feedback voltages $V_{FB1}$ through $V_{FB4}$ of the LED arrays CH1 through CH4 using the outputs of the comparators 111 through 114 and the feedback voltages $V_{FB1}$ through $V_{FB4}$ of the LED arrays CH1 through CH4.

For example, when none of the LED arrays CH1 through CH4 are connected, the minimum feedback voltage selector 115 outputs the lowest voltage of the feedback voltages $V_{FB1}$ through $V_{FB4}$ of the unconnected LED arrays CH1 through CH4 as the minimum feedback voltage Min_$V_{FB}$. When at least one of the LED arrays CH1 through CH4 is connected, the minimum feedback voltage selector 115 outputs the lowest voltage of the feedback voltages $V_{FB1}$ through $V_{FB4}$ of the LED arrays CH1 through CH4 that are connected, as the minimum feedback voltage Min_$V_{FB}$. In this case, the minimum feedback voltage selector 115 excludes the feedback voltages $V_{FB1}$ through $V_{FB4}$ of the disconnected LED arrays CH1 through CH4 among the LED arrays CH1 through CH4 based on the outputs of the comparators 111 through 114, and detects and outputs the minimum feedback voltage Min_$V_{FB}$ of the feedback voltages $V_{FB1}$ through $V_{FB4}$ of the LED arrays CH1 through CH4 that are connected.

A plurality of AND gates 116 outputs the selection signal ALL_OPEN based on the connection status of the LED arrays CH1 through CH4 output by the comparators 111 through 114. Herein, the selection signal ALL_OPEN has the high state when it is determined that none of the LED arrays CH1 through CH4 are connected.

The voltage detector 110 outputs the feedback voltage Vamp_fb_1 and the feedback voltage Vamp_fb_2 based on the minimum feedback voltage Min_$V_{FB}$. For example, the feedback voltage Vamp_fb_1 is the voltage to boost the initial driving voltage $V_{OUT}$ applied to the LED arrays CH1 through CH4 when none of the LED arrays CH1 through CH4 are connected or at least one of the LED arrays CH1 through CH4 is connected.

Thus, when none of the LED arrays CH1 through CH4 are connected or at least one of the LED arrays CH1 through CH4 is connected, the voltage detector 110 outputs the minimum feedback voltage Min_$V_{FB}$ at the GND level until the first control signal OVPO is high. When the control signal OVPO is high, the voltage detector 110 generates the feedback voltage Vamp_fb_1 by outputting the minimum drain voltage of the drain voltages of the sink transistor 410 of the LED driver 400 to drive the LED arrays CH1 through CH4 according to the driving voltage $V_{OUT}$ applied to the LED arrays CH1 through CH4.

Meanwhile, the feedback voltage Vamp_fb_2 indicates the minimum drain voltage of the drain voltages of the sink transistor 410 of the LED driver 400 to drive the LED array arrays CH1 through CH4 according to the driving voltage $V_{OUT}$ applied to the LED arrays CH1 through CH4. Hence, the voltage detector 110 generates the feedback voltage Vamp_fb_2 by outputting the minimum drain voltage of the 410 of the LED driver 400 to drive the LED arrays CH1 through CH4 that are connected when at least one of the LED arrays CH1 through CH4 is connected. However, when the selection signal ALL_OPEN is generated, the voltage detector 110 does not generate the feedback voltage Vamp_fb_2.

Now, the operations of the LED driver circuit 1000 according to a general aspect are described by referring to FIGS. 5 through 7. FIGS. 5 through 7 are waveform diagrams illustrating examples of operations of the LED driver circuit 1000 according to a general aspect. FIG. 5 depicts a Pulse Generator (PG) signal 501, a dimming signal PWMI 502, an ALL_OPEN signal 503, a control signal OVPO 504, a PWM signal PWM_OUT 505, $V_{OUT}$ 506, and Vamp_fb_1 and Vamp_fb_2 507. FIG. 6 depicts a PG signal 601, a dimming signal PWMI 602, an ALL_OPEN signal 603, a control signal VOUTO 604, a PWM signal PWM_OUT 605, $V_{OUT}$ 606, and Vamp_fb_1 and Vamp_fb_2 607. FIG. 7 depicts a PG signal 701, a dimming signal PWMI 702, an ALL_OPEN signal 703, a control signal OVPO 704, a PWM signal PWM_OUT 705, $V_{OUT}$ 706, and Vamp_fb_1 and Vamp_fb_2 707.

Herein, the $V_{OUT}$ 506, 606, 706 indicates the driving voltage $V_{OUT}$ applied to the LED arrays of the LED array unit 300, and the $V_{FB}$ 507, 607, 707 indicates the feedback voltage of the LED arrays of the LED array unit 300, that is, the drain voltage of the sink transistor 410 of the LED driver 400 to drive the LED arrays of the LED array unit 300.

FIG. 5 is a waveform diagram illustrating an example of the operations of the LED driver circuit 1000 when none of the LED arrays of the LED array unit 300 are connected. First, the PG signal 501 is input for the LED IC operation.

The PM controlling circuit 100 generates the PWM signal PWM_OUT 505 to control the initial boosting of the LED arrays of the LED array unit 300. For example, the PWM controlling circuit 100 generates the high PWM signal PWM_OUT 505 at the oscillator 135, which generates the clock signal of the preset frequency, and, thus, the driving voltage $V_{OUT}$ applied to the LED arrays of the LED array unit 300 is boosted.

In the meantime, when determining that none of the LED arrays of the LED array unit 300 are connected, the feedback voltage Vamp_fb_1 is set to the GND level until the driving voltage $V_{OUT}$ applied to the LED arrays of the LED array unit 300 reaches the preset voltage V_ovp_TH. Hence, since the feedback voltage Vamp_fb_1 is less than the reference voltage $V_{REF}$ to operate the sink transistor 410 of the LED driver 400 to drive the LED arrays of the LED array unit 300 in the saturation region, the driving voltage $V_{OUT}$ applied to the LED arrays of the LED array unit 300 continuously rises. Herein, the preset voltage V_ovp_TH can be set to two different voltages V_ovp_TH1 and V_ovp_TH2 according to the hysteresis property.

Since none of the LED arrays of the LED array unit 300 are connected, the PWM controlling circuit 100 generates the PWM signal PWM_OUT 505 to abort the boosting by comparing the feedback voltage $V_{OVP}$ generated by the feedback unit 500 and the preset voltage Vref1. For example, when the feedback voltage $V_{OVP}$ generated by the feedback unit 500 reaches the preset voltage Vref1, the controller 120 generates the high control signal OVPO 504. The high control signal OVPO 504 is input to the reset of the RS flip-flop 136 via the OR gate 135, and the high PWM signal PWM_OUT 505 becomes low.

Accordingly, the PWM controlling circuit 100 generates the low PWM signal PWM_OUT 505 to the driving voltage generator 200 so that the boosting of the driving voltage generator 200 is aborted. That is, upon determining that none of the LED arrays of the LED array unit 300 are connected, the LED driver circuit 1000 controls not to apply the overvoltage to the LED arrays of the LED array unit 300 by generating the control signal OVPO using the feedback voltage $V_{OVP}$ generated by the feedback unit 500.

FIG. 6 is a waveform diagram illustrating an example of the operations of the LED driver circuit 1000 when the dimming signal 602 is on and at least one LED array of the LED array unit 300 is connected. First, the PG signal 601 is input for the LED IC operation. The PWM controlling circuit 100 generates the PWM signal PWM_OUT 605 to control the initial boosting of the LED arrays of the LED array unit 300. For example, the PWM controlling circuit 100 generates the high PWM signal PWM_OUT 605 at the oscillator 135, which generates the clock signal of the preset frequency, and, thus, the driving voltage $V_{OUT}$ applied to the LED arrays of the LED array unit 300 is boosted.

In the meantime, when determining that at least one LED array of the LED arrays of the LED array unit 300 is connected, the feedback voltage Vamp_fb_1 is set to the GND level until the feedback voltage Vamp_fb_2 reaches the preset voltage Vref2. Hence, since the feedback voltage Vamp_fb_1 is smaller than the reference voltage $V_{REF}$ to operate the sink transistor 410 of the LED driver 400 to drive the LED arrays of the LED array unit 300 in the saturation region, the driving voltage $V_{out}$ applied to the LED arrays of the LED array unit 300 continuously rises.

Since at least one LED array of the LED arrays of the LED array unit 300 is connected, the PWM controlling circuit 100 generates the PWM signal PWM_OUT 605 to control the boosting by comparing the minimum feedback voltage Vamp_fb_2 of the feedback voltages of the LED arrays of the LED array unit 300 that are connected and the preset voltage Vref2.

In detail, when the minimum feedback voltage Vamp_fb_2 of the feedback voltages of the connected LED array, that is, the minimum drain voltage of the drain voltages of the sink transistor 410 of the LED driver to drive the LED arrays of the LED array unit 300 that are connected, reaches the preset voltage Vref2, the controller 120 generates the second control signal VOUTO 604 of the high state. The control signal VOUTO 604 of high state is input to the reset of the RS flip-flop 136 via the OR gate 135 and thus, the high PWM signal PWM_OUT 605 of high state becomes low. Herein, the preset voltage Vref2 is the voltage greater than the voltage V_FB_target to operate the sink transistor 410 of the LED driver 400, which drives the LED arrays of the LED array unit 300 in the saturation region, and may have two different voltages Vref2_H and Vref2_L (1.4V/1.2V, respectively) of hysteresis property.

In this case, the feedback voltage of the LED arrays of the LED array unit 300, not the feedback voltage $V_{OVP}$ generated by the feedback unit 500, that is, the minimum drain voltage from among the drain voltages of the sink transistor 410 of the LED driver 400 to drive the LED arrays of the LED array unit 300, is used to generate the control signal VOUTO 640. This is the difference between FIG. 5 and FIG. 6.

In FIG. 6, when the minimum feedback voltage Vamp_fb_2 from among the feedback voltages of the LED arrays of the LED array unit 300 that are connected reaches the preset voltage Vref2, the boosting is aborted. Accordingly, the rise of the driving voltage $V_{OUT}$ applied to the LED arrays of the LED array unit 300 stops not at the preset voltage V_ovp_TH but at the target voltage Vout_target (that is, the driving voltage $V_{OUT}$ that should be applied to the LED arrays of the LED array unit 300 to operate the sink transistor 410 of the LED driver 400, which operates the LED arrays of the LED array unit 300 in the saturation region) so as to prevent the overvoltage from being applied to the LED arrays of the LED array unit 300.

FIG. 7 is a waveform diagram illustrating an example of the operations of the LED driver circuit 1000 when the dimming signal PWMI 702 is off and at least one LED array of the LED arrays of the LED array unit 300 is connected. First, the PG signal 701 is input for the LED IC operation. The PWM controlling circuit 100 generates the PWM signal PWM_OUT 705 to control the initial boosting of the LED arrays of the LED array unit 300. For example, the PWM controlling circuit 100 generates the high PWM signal PWM_OUT 705 at the oscillator 135, which generates the clock signal of the preset frequency, and, thus, the driving voltage $V_{OUT}$ applied to the LED arrays of the LED array unit 300 is boosted.

In the meantime, when it is determined that at least one LED array of the LED arrays of the LED array unit 300 is connected and the dimming signal PWMI 702 is off, the feedback voltage Vamp_fb_1 is set to the GND level until the feedback voltage Vamp_fb_2 reaches the preset voltage Vref2. Hence, since the feedback voltage Vamp_fb_1 is less than the reference voltage $V_{REF}$ to operate the sink transistor 410 of the LED driver 400 driving the LED arrays of the LED array unit 300 in the saturation region, the driving voltage $V_{OUT}$ applied to the LED arrays of the LED array unit 300 continuously rises.

When determining that at least one LED array of the LED arrays of the LED array unit 300 is connected and a dimming signal PWMI 702 is off, the LED driving circuit 1000 according to a general aspect may generate the PWM signal PWM_OUT 705 to compare the feedback voltage $V_{OVP}$ generated by the feedback unit 500 with the preset voltage Vref1 and abort the boosting operation as illustrated in FIG. 5.

For example, when the feedback voltage $V_{OVP}$ generated by the feedback unit 500 reaches the preset voltage Vref1, the controller 120 generates the high control signal OVPO 704. The high control signal OVPO 704 is input to the reset of the RS flip-flop 136 via the OR gate 135, and the high PWM signal PWM_OUT 705 becomes low. Accordingly, the PWM controlling circuit 100 generates and outputs the low PWM signal PWM_OUT 705 to the driving voltage generator 200 so that the LED array boosting of the driving voltage generator 200 is aborted.

In the meantime, if the dimming signal PWMI 702 turns off, the driving voltage $V_{OUT}$ applied to the LED arrays of the LED array unit 300 rises and the feedback voltage Vamp_fb_2 of the LED arrays of the LED array unit 300, that is, the drain voltage of the sink transistor 410 of the LED driver 400 driving the LED arrays of the LED array unit 300, rises dramatically.

Accordingly, the PWM controlling circuit 100 generates the PWM signal PWM_OUT 705 to compare the feedback voltage $V_{OVP}$ generated by the feedback unit 500 with the preset voltage Vref1 and abort the boosting operation as illustrated in FIG. 5 instead of generating the PWM signal PWM_OUT 705 to compare the minimum feedback voltage Vamp_fb_2 from among the feedback voltages of the LED arrays of the LED array unit 300 that are connected and the preset voltage Vref2 and abort the boosting operation as illustrated in FIG. 6.

In FIGS. 6 and 7, after the driving voltage $V_{OUT}$ applied to the LED arrays of the LED array unit 300 reaches the target voltage, the PWM controlling circuit 100 generates the PWM signal PWM_OUT 605, 705 to control the LED array boosting using the minimum feedback voltage Vamp_fb_1 of the feedback voltages of the LED arrays of the LED array unit 300 that are connected. Herein, when the driving voltage $V_{OUT}$ applied to the LED arrays of the LED array unit 300 reaches the preset voltage V_ovp_TH or the feedback voltage Vamp_fb_2 reaches the preset voltage Vref2, the feedback voltage Vamp_fb_1 is set to the minimum drain voltage of the drain voltages of the sink transistor 410 of the LED driver 400 to drive the LED arrays of the LED array unit 300, and then output.

Thus, the PWM controlling circuit 100 generates the signal to control the LED array boosting using the feedback voltage Vamp_fb_1 so that the sink transistor 410 of the LED driver 400, which is driving the LED arrays of the LED array unit 300, operates in the saturation region. For example, when the feedback voltage Vamp_fb_1 is less than the voltage to operate the sink transistor 410 of the LED driver 400 in the saturation region, the PWM controlling circuit 100 may output the high PWM signal PWM_OUT 505, 605, 705 and generate the signal to commence the LED array boosting. When the feedback voltage Vamp_fb_1 is greater than the voltage to operate the sink transistor 410 of the LED driver 400 in the saturation region, the PWM controlling circuit 100 may generate the signal to abort the LED array boosting. Thus, the LED driver circuit 1000 may operate in a regulation mode.

According to the teachings above, there is provided an LED driver circuit that may determine the connection status of the LED arrays of the LED array unit, and prevent overvoltage from being applied to the LED arrays of the LED array unit by using the minimum feedback voltage of LED arrays that are connected. As a result, when at least one LED array is connected, a separate external device to prevent overvoltage applied to the LED arrays of the LED array unit is unnecessary. Therefore, it may be possible to reduce the required cost when an external device to control overvoltage is changed or omitted in the development and test processes.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A Light Emitting Diode (LED) driver circuit comprising:

a voltage detector configured to:

determine, for a plurality of LED arrays, whether each of the LED arrays is connected to the voltage detector based upon a corresponding feedback voltage signal;

output a selection signal indicating whether all of the LED arrays are connected to the voltage detector; and detect a minimum feedback voltage among the feedback voltage signals corresponding to the LED arrays that are determined to be connected;

a controller configured to select from a first control signal to abort boosting of the LED arrays and a second control signal to control boosting of the LED arrays, based on the selection signal, the second control signal being based on the detected minimum feedback voltage;

a Pulse Width Modulation (PWM) signal generator configured to output a PWM signal based on the selected control signal; and a driving voltage generator configured to supply a driving voltage commonly to the LED arrays based on the PWM signal.

2. The LED driver circuit of claim 1, further comprising:

a feedback unit configured to:

detect the driving voltage;

generate a feedback signal based on the detected driving voltage; and output the generated feedback signal to the controller, wherein in response to the selection signal indicating that all of the LED arrays are connected to the voltage detector or a dimming signal configured to drive the LED arrays being off, the controller is configured to output the selected first control signal to abort the boosting based on the feedback signal.

3. The LED driver circuit of claim 2, wherein the controller comprises a comparator configured to:

compare the generated feedback signal and a preset voltage; and generate the first control signal according to the comparing of the generated feedback signal and the preset voltage.

4. The LED driver circuit of claim 3, wherein:

the controller is further configured to generate the first control signal comprising a high control signal in response to the generated feedback signal being greater than the preset voltage; and in response to the high control signal being input, the PWM signal generator is configured to generate the PWM signal to abort the boosting.

5. The LED driver circuit of claim 1, wherein the voltage detector is further configured to:

compare a preset voltage with the feedback voltage signal corresponding to each of the LED arrays; and determine whether each of the LED arrays is connected to the voltage detector based upon the comparison.

6. The LED driver circuit of claim 5, wherein the preset voltage is 0V or 0.2V.

7. The LED driver circuit of claim 1, wherein:

the controller comprises a comparator configured to:

compare the detected minimum feedback voltage and a preset voltage; and generate the second control signal based on the comparison; and the preset voltage is greater than a voltage configured to operate a transistor that drives each of the LED arrays that are determined to be connected and are operating in a saturation region.

8. The LED driver circuit of claim 7, wherein the comparator is configured to generate a switching signal, and receive an input of a dimming signal configured to drive the LED arrays.

9. The LED driver circuit of claim 8, wherein:

the controller is further configured to generate the second control signal in response to the dimming signal being on and the detected minimum feedback voltage being greater than the preset voltage; and the PWM signal generator is configured to generate the PWM signal to abort the boosting in response to receiving the first control signal in a high state.

10. The LED driver circuit of claim 8, wherein the preset voltage includes two different voltages of hysteresis property.

11. The LED driver circuit of claim 7, wherein the preset voltage prevents an overvoltage from being supplied to the LED arrays.

12. The LED driver circuit of claim 1, wherein the voltage detector comprises:

a plurality of AND gates configured to generate the selection signal.

13. The LED driver circuit of claim 1, wherein the voltage detector is configured detect the minimum feedback voltage among the feedback voltage signals in response to all of the LED arrays being connected.

14. The LED driver circuit of claim 1, wherein the selection signal is in a high state in response to none of the LED arrays being connected to the voltage detector.

15. A Light Emitting Diode (LED) driver circuit, comprising:

a voltage detector comprising:

comparators respectively corresponding to LED arrays, the comparators being configured to:

compare a feedback voltage signal corresponding to each of the LED arrays with a preset voltage; and indicate whether each LED array is connected to a voltage detector based upon the comparison; and a minimum feedback voltage selector configured to:

receive the indications of whether each of the LED arrays is connected to the voltage detector;

receive the feedback voltage signals corresponding to the LED arrays;

detect a minimum voltage signal among the received feedback voltage signals corresponding to LED arrays that are determined to be connected; and output the minimum voltage signal as the minimum feedback voltage;

a controller configured to output a control signal to control boosting of the LED arrays based on the detected minimum feedback voltage;

a Pulse Width Modulation (PWM) signal generator configured to output a PWM signal based on the outputted control signal; and a driving voltage generator configured to supply a driving voltage commonly to the LED arrays based on the PWM signal.

16. The LED driver circuit of claim 15, wherein the voltage detector is configured to output a selection signal indicating whether all of the LED arrays are connected to the voltage detector.

17. The LED driver circuit of claim 16, wherein the voltage detector comprises a plurality of logic gates configured to generate the selection signal, and an output of each of the comparators is coupled to at least one of the plurality of logic gates.

18. A Pulse Width Modulation (PWM) controlling circuit comprising:

a voltage detector configured to:

determine, for a plurality of light emitting diode (LED) arrays, whether each of the LED arrays is connected to the voltage detector based upon a corresponding feedback voltage signal;

output a selection signal indicating whether all of the LED arrays are connected to the voltage detector; and output a control voltage to control boosting of the LED arrays based on the determined connection status; and a controller configured to select from a first control signal to abort boosting of the LED arrays and a second control signal to control boosting of the LED arrays, based on the selection signal, the second control signal being based on the control voltage;

a PWM signal generator configured to output a PWM signal based on the selected control signal.

19. The PWM controlling circuit of claim 18, wherein the voltage detector comprises:

a plurality of AND gates configured to generate the selection signal.

20. The PWM controlling circuit of claim 18, wherein the voltage detector is configured detect the minimum feedback voltage among the feedback voltage signals in response to all of the LED arrays being connected.

* * * * *